US008376355B2

(12) United States Patent
Sugitani et al.

(10) Patent No.: US 8,376,355 B2
(45) Date of Patent: Feb. 19, 2013

(54) SHEET DISCHARGE DEVICE

(75) Inventors: Hiroshi Sugitani, Ibaraki-ken (JP); Naoya Masuda, Ibaraki-ken (JP); Kazuyuki Aoki, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 13/350,109

(22) Filed: Jan. 13, 2012

(65) Prior Publication Data

US 2012/0181742 A1 Jul. 19, 2012

(30) Foreign Application Priority Data

Jan. 17, 2011 (JP) ..... P2011-006933

(51) Int. Cl.
*B65H 43/00* (2006.01)

(52) U.S. Cl. ..... 271/176; 271/207; 271/220

(58) Field of Classification Search ..... 271/176, 271/207, 220, 902
See application file for complete search history.

(56) References Cited

U.S. PATENT DOCUMENTS

2007/0069453 A1* 3/2007 Thomas et al. ..... 271/207
2007/0108697 A1* 5/2007 Tamura et al. ..... 271/220
2007/0108698 A1* 5/2007 Tamura et al. ..... 271/220
2007/0145675 A1* 6/2007 Tamura et al. ..... 271/207

FOREIGN PATENT DOCUMENTS

JP 2002-12362 A 1/2002

* cited by examiner

*Primary Examiner* — David H Bollinger
(74) *Attorney, Agent, or Firm* — Nath, Goldberg & Meyer; Jerald L. Meyer; Scott C. Langford

(57) ABSTRACT

In a sheet discharge device, sheets are sequentially discharged by a sheet discharge roller with a leading end of each of the sheets in the lead in a sheet discharge direction and stacked on a sheet receiving tray inclining relative to a vertical direction. A sheet reverse member is disposed at such a position relative to the sheet receiving tray and the sheet discharge roller that a trailing end of a first sheet discharged by the sheet discharge roller reaches the sheet reverse member before a leading end of a second sheet discharged subsequently to the first sheet collides with the first sheet when a sheet time interval between the trailing end of the first sheet and the leading end of the second sheet is set to a minimum sheet time interval available in continuous sheet discharge in the sheet discharge device.

5 Claims, 7 Drawing Sheets

SHEET DISCHARGE DEVICE

CROSS REFERENCE TO RELATED APPLICATION

This application is based upon and claims the benefit of priority from the prior Japanese Patent Application No. 2011-006933, filed on Jan. 17, 2011, the entire contents of which are incorporated herein by reference.

BACKGROUND OF THE INVENTION

1. Field of the Invention

The present invention relates to a sheet discharge device for discharging sheets onto a sheet receiving tray inclined relative to the vertical direction.

2. Description of the Related Art

A sheet discharge device configured to sequentially discharge and stack sheets onto a sheet receiving tray by using sheet discharge rollers is usually employed in inkjet printing machines, stencil printing machines, laser beam printers, thermal transfer printing machines, copying machines (copiers), and the like.

As a relevant sheet discharge device, Japanese Unexamined Patent Application Publication No. 2002-12362 proposes a sheet stacking device, a post-processing device, and an image forming device which can prevent misalignment of sheets during an operation to shift a sheet receiving tray.

Now, the relevant sheet stacking device will be briefly described by referring to Japanese Unexamined Patent Application Publication No. 2002-12362.

In a relevant sheet stacking device 100 shown in FIG. 1, a side panel 101 of the sheet stacking device 100 is provided extending in the vertical direction.

A sheet receiving tray 102 to stack discharged sheets P is provided on an outer side of the side panel 101 in an inclined state at a predetermined angle relative to the side panel 101. This sheet receiving tray 102 is provided movable upward and downward along the side panel 101 and shiftable in the sheet width direction perpendicular to the sheet discharge direction of the sheet P (direction normal to FIG. 1) for the purpose of sorting sheets P.

Sheet discharge rollers 103 including pairs of drive roller 103A and driven roller 103B for discharging a sheet P are provided rotatably in an upper side of the side panel 101.

A sheet reverse roller 104 is provided above a top surface 102*a* of the sheet receiving tray 102 in the vicinity of a base end 102*b* of the sheet receiving tray 102. This sheet reverse roller 104 is rotatable by the same drive source as each drive roller 103A of the sheet discharge rollers 103.

When a discharged sheet P falls down by its own weight along the sheet receiving tray 102 inclined at a predetermined angle or on a sheet(s) P stacked thereon, the sheet reverse roller 104 moves the discharged sheet P from the trailing end in the opposite direction to the sheet discharge direction and hits the trailing end against the side panel 101. As a result, the trailing ends of multiple sheets P stacked on the sheet receiving tray 102 are aligned along the side panel 101.

When the sheet receiving tray 102 is shifted, the shifting operation is performed after lowering the sheet receiving tray 102 by a lowering distance k to separate the top surface of the sheet(s) P stacked on the sheet receiving tray 102 from the sheet reverse roller 104.

SUMMARY OF THE INVENTION

When sheets P are sequentially discharged and stacked onto the sheet receiving tray 102 by the sheet discharge rollers

103 in the relevant sheet stacking device 100 described above, sheets P (P1, P2, . . . ) discharged on the sheet receiving tray 102 or on the already stacked sheet(s) P may possibly be disposed obliquely as shown in FIG. 2 even though the sheet reverse roller 104 is provided above the base end 102*b* of the sheet receiving tray 102 to let the trailing ends Pr of the sheets P (P1, P2, . . . ) hit against the side panel 101 and be aligned.

To pursue the cause of the oblique disposition of a discharged sheet P on the sheet receiving tray 102 or on an already stacked sheet(s) P, the present inventor experimentally manufactured a prototype device by applying the technical idea of the relevant sheet stacking device 100 disclosed in Japanese Unexamined Patent Application Publication No. 2002-12362. The present inventor tested sheet discharge operations of a prototype device 100A to which the relevant technique is applied, as shown in FIGS. 3A to 3E.

Specifically, as shown in FIGS. 3A to 3E, in the prototype device 100A to which the technical idea of the relevant sheet stacking device 100 is applied, a side panel 101 is provided extending in the vertical direction, and a sheet receiving tray 102 is attached movable upward and downward along the side panel 101. Here, the sheet receiving tray 102 is attached inclining obliquely upward at approximately 30° relative to the horizontal direction perpendicular to the side panel 101.

A sheet discharge port 101*a* is formed opening in an upper portion of the side panel 101. Moreover, a sheet guide portion 101*b* to guide the trailing end Pr of each sheet P is provided below the sheet discharge port 101*a*. This sheet guide portion 101*b* is bent substantially at a right angle to a top surface 102*a* of the sheet receiving tray 102.

Sheet discharge rollers 103 are provided rotatably in the vicinity of the sheet discharge port 101*a* in the side panel 101. The sheet discharge rollers 103 include pairs of upper drive roller 103A connected to an unillustrated drive source and lower driven roller 103B.

A sheet reverse roller 104 is provided above the top surface 102*a* of the sheet receiving tray 102 in the vicinity of a base end 102*b* of the sheet receiving tray 102. This sheet reverse roller 104 is rotatable by the same drive source as each drive roller 103A of the sheet discharge rollers 103. Moreover, the sheet reverse roller 104 is disposed across the sheet guide portion 101*b* of the side panel 101.

Now, sheet discharge operations in the above-described prototype device 100A will be described step by step.

First, as shown in FIG. 3A, in a process to sequentially discharge sheets P at a high speed by rotating the sheet discharge rollers 103 in the prototype device 100A, a discharge target sheet P1 is discharged from its leading end Pf at a high speed in a sheet discharge direction indicated by an arrow. During the discharge, the sheet reverse roller 104 is rotated counterclockwise.

Then, as shown in FIG. 3B, the sheet P1 discharged by the sheet discharge rollers 103 falls on the top surface 102*a* of the sheet receiving tray 102.

Then, as shown in FIG. 3C, the sheet P1 having fallen on the top surface 102*a* of the sheet receiving tray 102 lies along the top surface 102*a*. At the same time, the subsequent sheet P2 starts to be discharged by the sheet discharge rollers 103.

Then, as shown in FIG. 3D, the sheet P1 lying along the top surface 102*a* of the sheet receiving tray 102 starts to fall down along the top surface 102*a* from its trailing end Pr side by its own weight, i.e., by the inclination of the top surface 102*a*. On the other hand, the leading end Pf of the subsequently discharged sheet P2 collides with the previously discharged sheet P1 that is falling down by its own weight on the sheet receiving tray 102. In this event, the trailing end Pr side of the previously discharged sheet P1 that is falling down by its own weight has not reached the location of the sheet reverse roller 104. Hence, the collision by the subsequent sheet P2 moves the previously discharged sheet P1 lying underneath in the widthwise direction and/or the lengthwise direction. As a consequence, the discharged lower sheet P1 loses its symmetrical balance and becomes tilted relative to the top surface 102*a* of the sheet receiving tray 102 as shown earlier in FIG. 2.

Then, as shown in FIG. 3E, the tilted lower sheet P1 on the top surface 102*a* of the sheet receiving tray 102 further falls down by its own weight and is nipped by the sheet reverse roller 104, and thereafter the trailing end Pr of the lower sheet P1 is caused to hit against a portion of the side panel 101 below the sheet guide portion 101*b*. Nonetheless, the lower sheet P1 remains disposed in the tilted state as shown in FIG. 2.

In the above case, a time interval between two consecutive sheets, specifically the trailing end Pr of the sheet P1 discharged previously by the sheet discharge rollers 103 and the leading end Pf of the sheet P2 discharged subsequent to the sheet P1 (hereinafter, referred to as sheet time interval), is set within a range of ±3% of V msec (millisecond), for example, regardless of the sheet length.

A sheet (unillustrated) discharged after the subsequent sheet P2 also collides with the sheet P2 and tilts the sheet P2 as described above. Thus, there is a problem that the trailing ends Pr of multiple sheets P cannot be aligned along the side panel 101 even when the sheet reverse roller 104 is provided.

An object of the present invention is to provide a sheet discharge device which can align the trailing ends, in the sheet discharge direction, of sheets stacked on a sheet receiving tray that is inclined relative to the vertical direction.

An aspect of the present invention is a sheet discharge device comprising: a sheet discharge roller configured to sequentially discharge sheets in a sheet discharge direction with a leading end of each of the sheets in the lead; a sheet receiving tray provided facing the sheet discharge roller and configured such that sheets discharged by the sheet discharge roller are sequentially stacked on the sheet receiving tray, the sheet receiving tray inclining relative to a vertical direction such that a side of a trailing end of each of the discharged sheets falls down by own weight thereof; a sheet reverse member configured to move the side of the trailing end of a sheet in a direction opposite to the sheet discharge direction, the sheet being in a state of falling down by own weight thereof along any one of a top surface of the sheet receiving tray and a sheet already stacked on the top surface of the sheet receiving tray; and an alignment fence configured to contact with the trailing end of a sheet moved in the opposite direction by the sheet reverse member to align the trailing end of the sheet stacked on the sheet receiving tray, wherein the sheet reverse member is disposed at such a position relative to the sheet receiving tray and the sheet discharge roller that the trailing end of a first sheet discharged by the sheet discharge roller reaches the sheet reverse member before the leading end of a second sheet discharged subsequently to the first sheet collides with the first sheet when a sheet time interval between the trailing end of the first sheet and the leading end of the second sheet is set to a minimum sheet time interval available in continuous sheet discharge in the sheet discharge device.

According to the aspect described above, the sheet reverse member is placed at such a position relative to the sheet receiving tray and the sheet discharge roller that, in a process to sequentially discharge sheets by the sheet discharge roller from their leading ends in the sheet discharge direction and stack the sheets onto the sheet receiving tray inclined relative to the vertical direction, the trailing end of a first sheet discharged previously by the sheet discharge roller reaches the sheet reverse member before the leading end of a second sheet discharged subsequent to the first sheet collides with the first sheet, when the sheet time interval between the trailing end of the first sheet and the leading end of the second sheet is set to the minimum sheet time interval available in continuous sheet discharge in the sheet discharge device. Accordingly, multiple sheets stacked on the sheet receiving tray can be aligned without being tilted when the trailing ends of the multiple sheets stacked on the sheet receiving tray are caused to hit against the alignment fence by the sheet reverse member. This contributes to a quality improvement of the sheet discharge device.

The sheet reverse member may be a rotatable sheet reverse roller configured to make rotational contact with a sheet, and the sheet reverse roller may be disposed at a limit position in the sheet discharge direction beyond which the sheet reverse roller comes into contact with a sheet discharged by the sheet discharge roller and falling toward the sheet receiving tray.

The sheet reverse member may be a rotatable sheet reverse roller configured to make rotational contact with a sheet, and the alignment fence may be disposed at such a position relative to the sheet reverse roller that the sheet reverse roller contacts with a margin region on the side of the trailing end of a sheet set by the sheet discharge device.

According to the configurations described above, the sheet reverse member is a rotatable sheet reverse roller configured to move a sheet from the trailing end thereof in the direction opposite to the sheet discharge direction by making rotational contact with the margin region on the trailing end side of the sheet set by the device. Thus, an image printed on the sheet is not deteriorated. Accordingly, a fine image can be provided.

The sheet discharge device may further comprise a sheet linear velocity detector configured to detect a linear velocity of a sheet having been discharged by the sheet discharge roller, wherein rotation of the sheet reverse roller is controlled based on a linear velocity detected by the sheet linear velocity detector.

According to the configuration described above, the sheet linear velocity detector configured to detect the linear velocity of a sheet having been discharged by the sheet discharge roller is provided, and the rotation of the sheet reverse roller is controlled based on the linear velocity of the discharged sheet detected by the sheet linear velocity detector. Accordingly, when the sheet reverse roller hits the trailing end of the discharged sheet against the alignment fence, the trailing end of the sheet can be aligned more securely than otherwise.

The sheet discharge device may further comprise a sheet linear velocity detector configured to detect a linear velocity of a sheet having been discharged by the sheet discharge roller, wherein the sheet discharge roller and the sheet reverse roller are configured to rotate at a same rotational speed, rotation of the sheet discharge roller and the sheet reverse roller is controlled such that the sheet discharge roller discharges a sheet at a first linear velocity while the sheet discharge roller is performing sheet discharge, and the rotation of the sheet discharge roller and the sheet reverse roller is controlled such that the sheet reverse roller moves a sheet at a second linear velocity detected by the sheet linear velocity detector while the sheet discharge roller is not performing sheet discharge.

DETAILED DESCRIPTION OF THE DRAWINGS

DETAILED DESCRIPTION OF THE EMBODIMENTS

Hereinbelow, sheet discharge devices according some embodiments of the present invention will be described in detail by referring to FIGS. 4 to 9.

Embodiment 1

Figure 1:
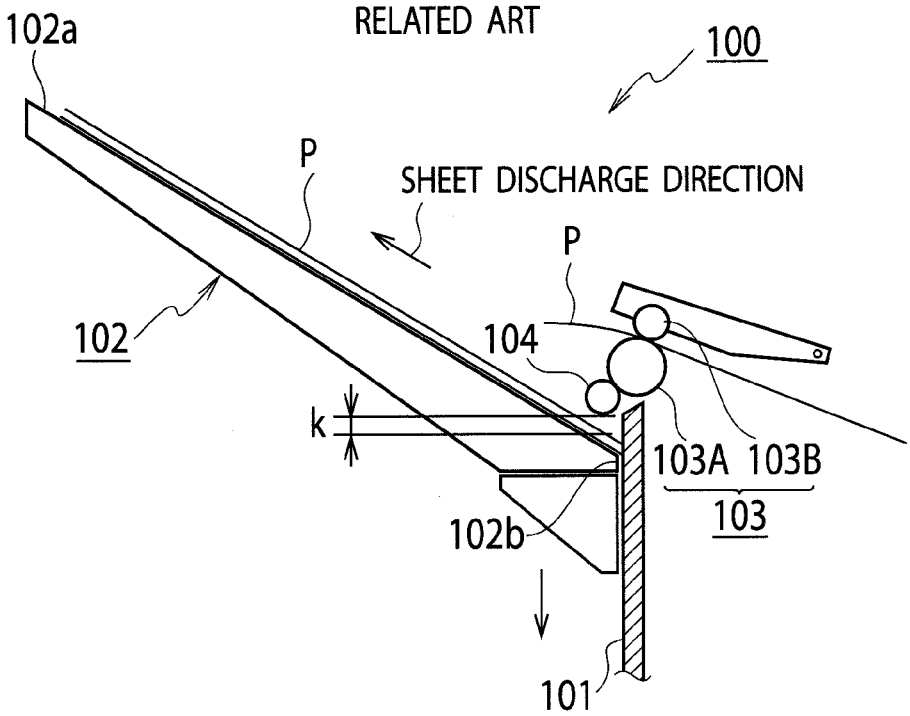
FIG. 1 RELATED ART
FIG. 1 is a configuration diagram showing a relevant sheet stacking device.
Figure 2:
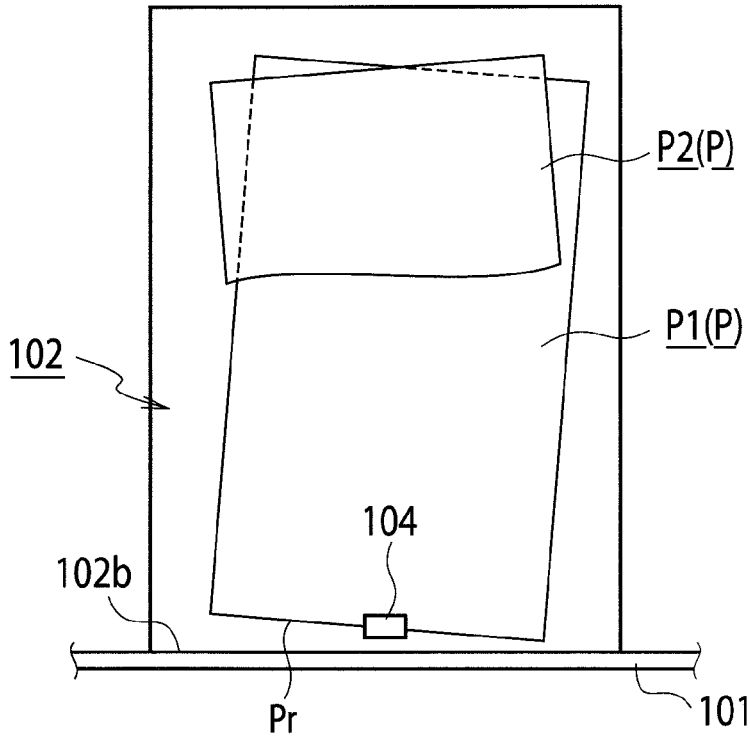
FIG. 2 RELATED ART
FIG. 2 is a diagram for describing the postures of sheets stacked on a sheet receiving tray as a result of discharging the sheets onto the sheet receiving tray by using the relevant sheet stacking device.
Figure 3A:
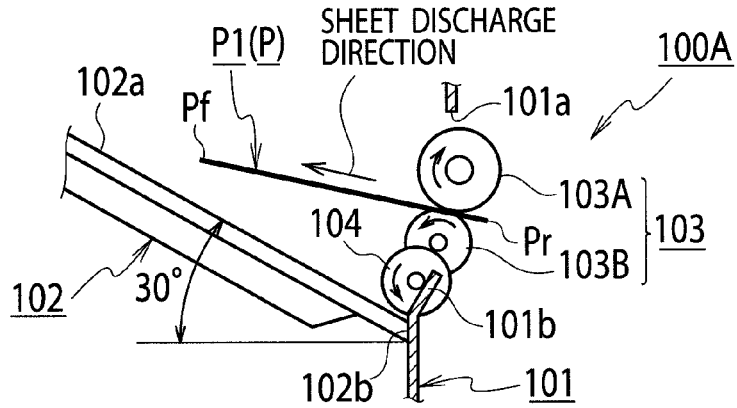
FIG. 3A RELATED ART
FIGS. 3A to 3E are diagrams for describing sheet discharge operations in a prototype device experimentally manufactured by applying the technical idea of the relevant sheet stacking device.
Figure 3B:
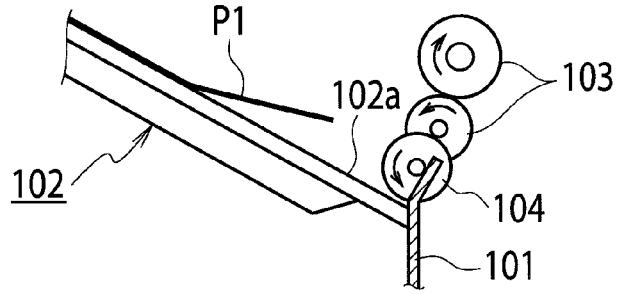
FIG. 3B RELATED ART
Figure 3C:
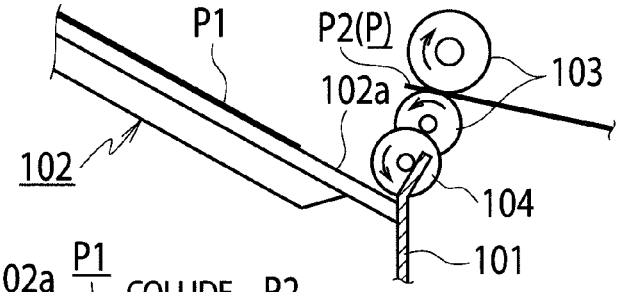
FIG. 3C RELATED ART
Figure 3D:
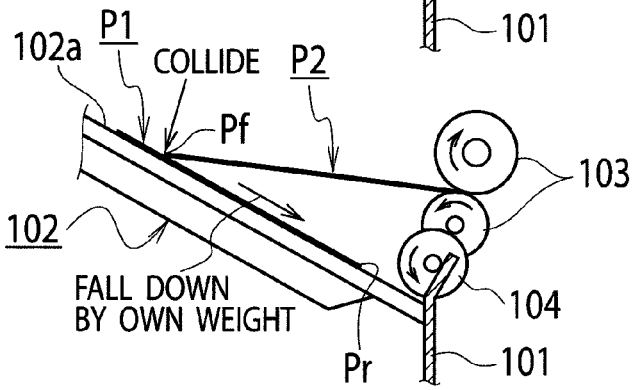
FIG. 3D RELATED ART
Figure 3E:
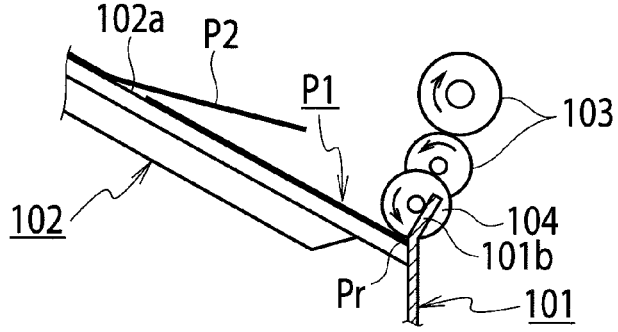
FIG. 3E RELATED ART
Figure 4:
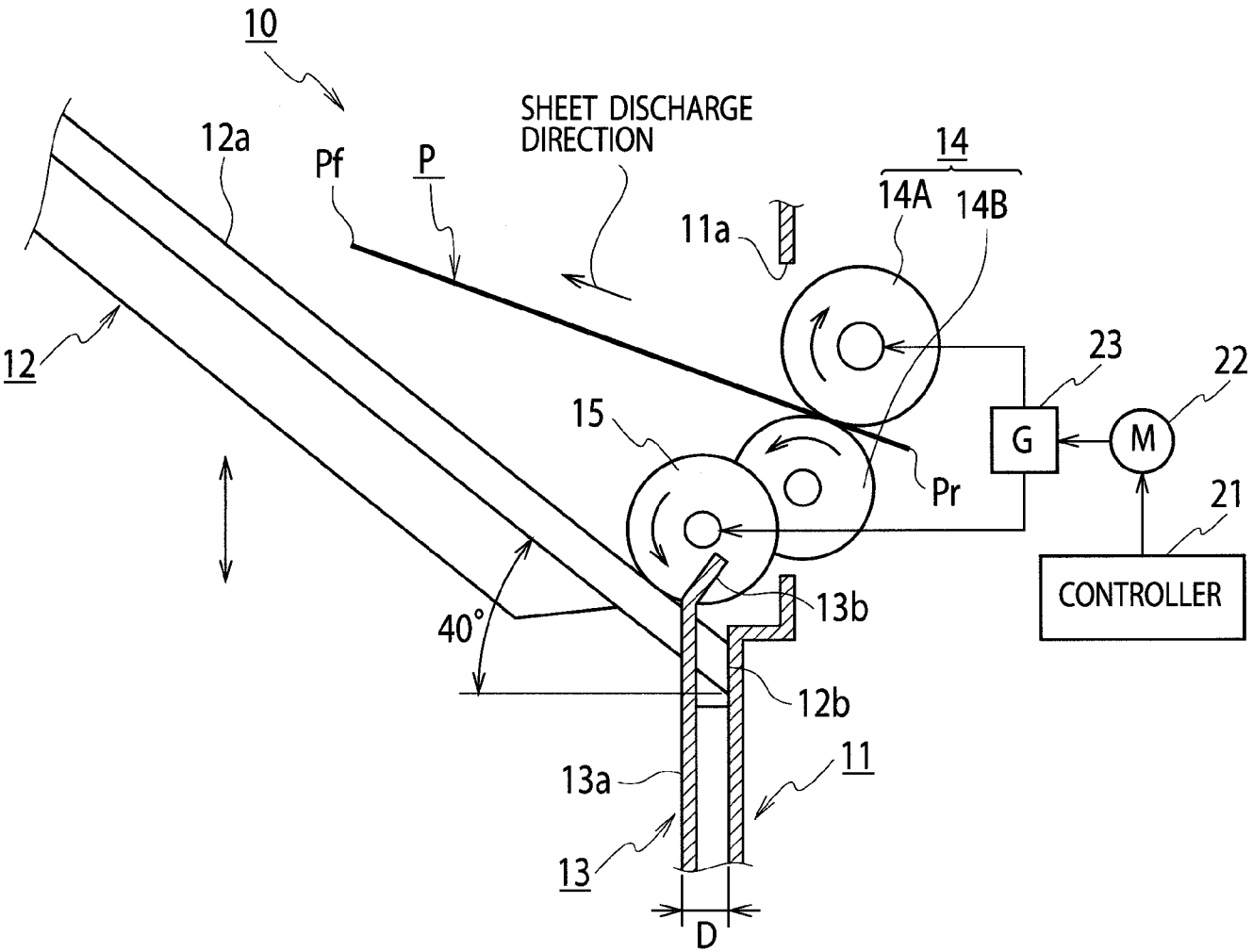
FIG. 4 is a configuration diagram showing a sheet discharge device according to Embodiment 1 of the present invention.

As shown in FIG. 4, a sheet discharge device 10 according to Embodiment 1 of the present invention is a device obtained by making improvements to the prototype device 100A (FIG. 3) experimentally manufactured by applying the technical idea of the relevant sheet stacking device 100 (FIG. 1). The sheet discharge device 10 has the following features. Sheets P are sequentially discharged at a high speed from their leading ends Pf in the sheet discharge direction by sheet discharge rollers 14 and stacked onto a sheet receiving tray 12 that is inclined at a predetermined angle relative to the vertical direction. Each discharged sheet P falls down from its trailing end Pr by its own weight on the inclined sheet receiving tray 12 or on an already stacked sheet(s) P. The trailing end Pr of a sheet P discharged on the sheet receiving tray 12 or on the already stacked sheet(s) P is nipped by a sheet reverse member (hereinafter, described as sheet reverse roller) 15, and after this nipping, the subsequently discharged sheet P is stacked onto the previously discharged sheet P. In this way, multiple stacked sheets P can be securely aligned on the sheet receiving tray 12 without being tilted.

In the sheet discharge device 10 according to Embodiment 1 of the present invention, a side panel 11 of the device 10 is provided extending in the vertical direction, and a sheet discharge port 11*a* is formed opening in an upper portion of the side panel 11.

The sheet receiving tray 12 to stack a discharged sheet P on a top surface 12*a* thereof is provided on an outer side of the side panel 11 in such a posture as to face the sheet discharge rollers 14.

The sheet receiving tray 12 is inclined at a predetermined angle relative to the side panel 11 so that a sheet P discharged by the sheet discharge rollers 14 can fall down by its own weight. The sheet receiving tray 12 is provided such that a base end 12*b* of the sheet receiving tray 12 can be guided and moved upward and downward along the side panel 11 and also that the base end 12*b* can be shifted in the sheet width direction perpendicular to the sheet discharge direction of the sheet P (direction normal to FIG. 4) for the purpose of sorting sheets P.

Here, the predetermined inclination angle of the sheet receiving tray 12 is set at approximately 40°, which is larger than the inclination angle (approximately 30°) in the prototype device 100A described earlier by using FIGS. 3A to 3E. In this way, a sheet P discharged onto the sheet receiving tray 12 can fall down by its own weight at a higher speed than in the case of the prototype device 100A. To be specific, the sheet receiving tray 12 is attached inclining obliquely upward at approximately 40° relative to the horizontal direction perpendicular to the side panel 11.

The predetermined inclination angle of the sheet receiving tray 12 that allows a sheet P discharged on the sheet receiving tray 12 to fall down by its own weight in the above manner may be set within a range of 35° to 45° relative to the side panel 11.

As for the shifting mechanism of the sheet receiving tray 12, a mechanism which is substantially the same as one disclosed in the aforementioned Japanese Unexamined Patent Application Publication No. 2002-12362 is employed; hence, detailed description thereof is omitted here.

An alignment fence 13 is provided at a front side, or the sheet receiving tray 12 side, of the outer side of the side panel 11 so as to be remote from the outer side by a small distance D. The alignment fence 13 is provided extending in the vertical direction in parallel with the side panel 11. The alignment fence 13 has a sheet end portion 13*a* against which the trailing end Pr of a sheet P stacked on the sheet receiving tray 12 is caused to hit. The sheet end portion 13*a* is provided extending vertically to be able to handle a certain number of stacked sheets P. The alignment fence 13 also has a sheet guide portion 13*b* in an upper side of the sheet end portion 13*a*. The sheet guide portion 13*b* is bent substantially at a right angle to the top surface 12*a* of the sheet receiving tray 12 and is configured to guide the trailing end Pr of each sheet P.

The alignment fence 13 is provided remote from the outer side of the side panel 11 by the small distance D for the purpose of making a later-described improvement to move the position of the sheet reverse roller 15 toward the front side (sheet receiving tray 12 side) so that the sheet reverse roller 15 can make rotational contact with the trailing end Pr of a discharged sheet P on the sheet receiving tray 12 more quickly than in the case of the prototype device 100A described earlier by using FIGS. 3A to 3E. Note that this improvement is made while maintaining the same positional relationship between the side panel 101 and the sheet discharge rollers 103 provided to the prototype device 100A.

The sheet discharge rollers 14 include pairs of driver roller 14A and driven roller 14B formed by using a rubber material for the purpose of discharging sheets P, and are provided rotatably in the vicinity of the sheet discharge port 11*a* opening in the upper portion of the side panel 11.

Each drive roller 14A of the sheet discharge rollers 14 is connected via a gear train 23 to a geared motor 22 driven in accordance with an instruction from a controller 21 and is rotatable clockwise. Each driven roller 14B is driven by the corresponding drive roller 14A and is rotatable counterclockwise. Accordingly, by allowing a sheet P to be sandwiched and conveyed by both rollers 14A and 14B, the sheet P is discharged from its leading end Pf of the sheet P in the sheet discharge direction indicated by an arrow.

When the predetermined inclination angle of the sheet receiving tray 12 is set at approximately 40°, an angle of 15° to 20° is formed between the top surface 12*a* of the sheet receiving tray 12 and a sheet P that is being discharged in the sheet discharge direction. The leading end Pf of the sheet P moves toward the sheet receiving tray 12 at this angle.

The sheet reverse roller 15 is provided above the top surface 12*a* of the sheet receiving tray 12 across the sheet guide portion 13*b* of the alignment fence 13. By using a sponge material, the sheet reverse roller 15 is provided capable of making rotational contact with the trailing end Pr side of a sheet P discharged on the sheet receiving tray 12.

Figure 8:
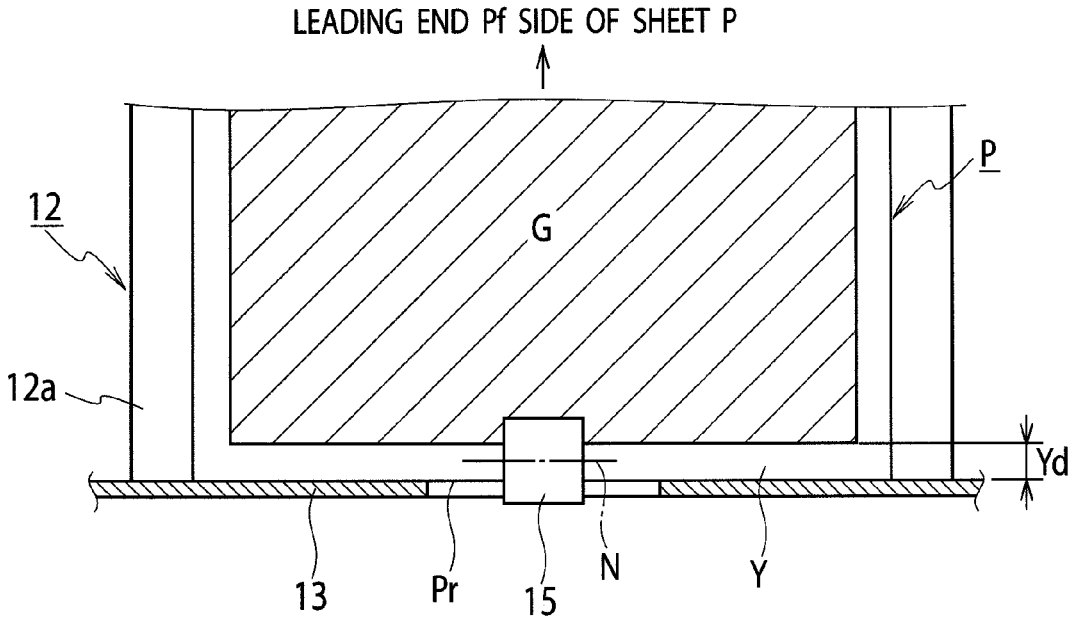
FIG. 8 is an enlarged diagram showing a trailing end side of a sheet to describe in what posture the sheet is stacked on a sheet receiving tray when the sheet is discharged onto the sheet receiving tray by using the sheet discharge device according to Embodiment 1 of the present invention.

As shown in later-described FIG. 8, a nipping point N on the discharged sheet P at which the sheet reverse roller 15 makes rotational contact with the sheet P is within a region Yd of a margin Y on the trailing end Pr side of the sheet P where an image G is not formed. The region Yd is set by the device 10. The region Yd of the margin Y based on the setting of the device 10 is a space between the trailing end Pr and a position inward of the trailing end Pr by approximately 1 to 3 mm, for example.

The sheet reverse roller 15 is connected via the gear train 23 to the geared motor 22 driven in accordance with an instruction from the controller 21 and is provided rotatably counterclockwise. The rotational speed of the sheet reverse roller 15 is set at the same rotational speed as each drive roller 14A of the sheet discharge rollers 14 due to the configuration of the gear train 23 to be described later.

The sheet reverse roller 15 has the following function. Specifically, after the trailing end Pr side of a sheet P discharged on the sheet receiving tray 12 inclined at the predetermined angle or on a sheet(s) P stacked thereon falls by gravity, the sheet reverse roller 15 makes rotational contact with the trailing end Pr side of the sheet P to hit the trailing end Pr of the sheet P against the alignment fence 13, so that the trailing ends Pr of multiple sheets P stacked on the sheet receiving tray 12 are aligned along the alignment fence 13.

Since the alignment fence 13 is arranged closer to the front side (sheet receiving tray 12 side) by the small distance D than the side panel 101 of the prototype device 100A (FIGS. 3A to 3E), the sheet reverse roller 15 is placed closer to the front side by the small distance D than is the sheet reverse roller 104 (FIGS. 3A to 3E) of the prototype device 100A (FIGS. 3A to 3E). Accordingly, the sheet reverse roller 15 makes rotational contact with the trailing end Pr side of the discharged sheet P more quickly than in the case of the prototype device 100A. The sheet reverse roller 15 is located at a limit position which is closest possible to the sheet receiving tray 12 (in the sheet discharge direction) and beyond which the sheet reverse roller 15 comes into contact with a sheet P that has been discharged by the sheet discharge rollers 14 and is exiting/falling toward the sheet receiving tray 12. In other words, the sheet reverse roller 15 is placed at a limit position beyond which the sheet reverse roller 15 comes into contact with a trajectory which the trailing end Pr of the sheet P discharged from the sheet discharge rollers 14 passes at the time of discharge and fall. The limit position is slightly remote from the trajectory which the trailing end Pr of the sheet P passes at the time of discharge and fall, toward the sheet discharge rollers 14 side (in the opposite direction to the sheet discharge direction). For example, the limit position is remote from the trajectory by several millimeters to several centimeters. A reference sheet trajectory used to determine the arrangement position of the sheet reverse roller 15 is the trajectory of a sheet discharged by the sheet discharge rollers 14 and having the shortest travelling distance (the trajectory of a sheet discharged by the sheet discharge rollers 14 at the lowest discharge speed) in the sheet discharge direction.

Now, a specific configuration example of each of the aforementioned sheet discharge rollers 14 and sheet reverse roller 15 will be described by using FIG. 5.

Figure 5:
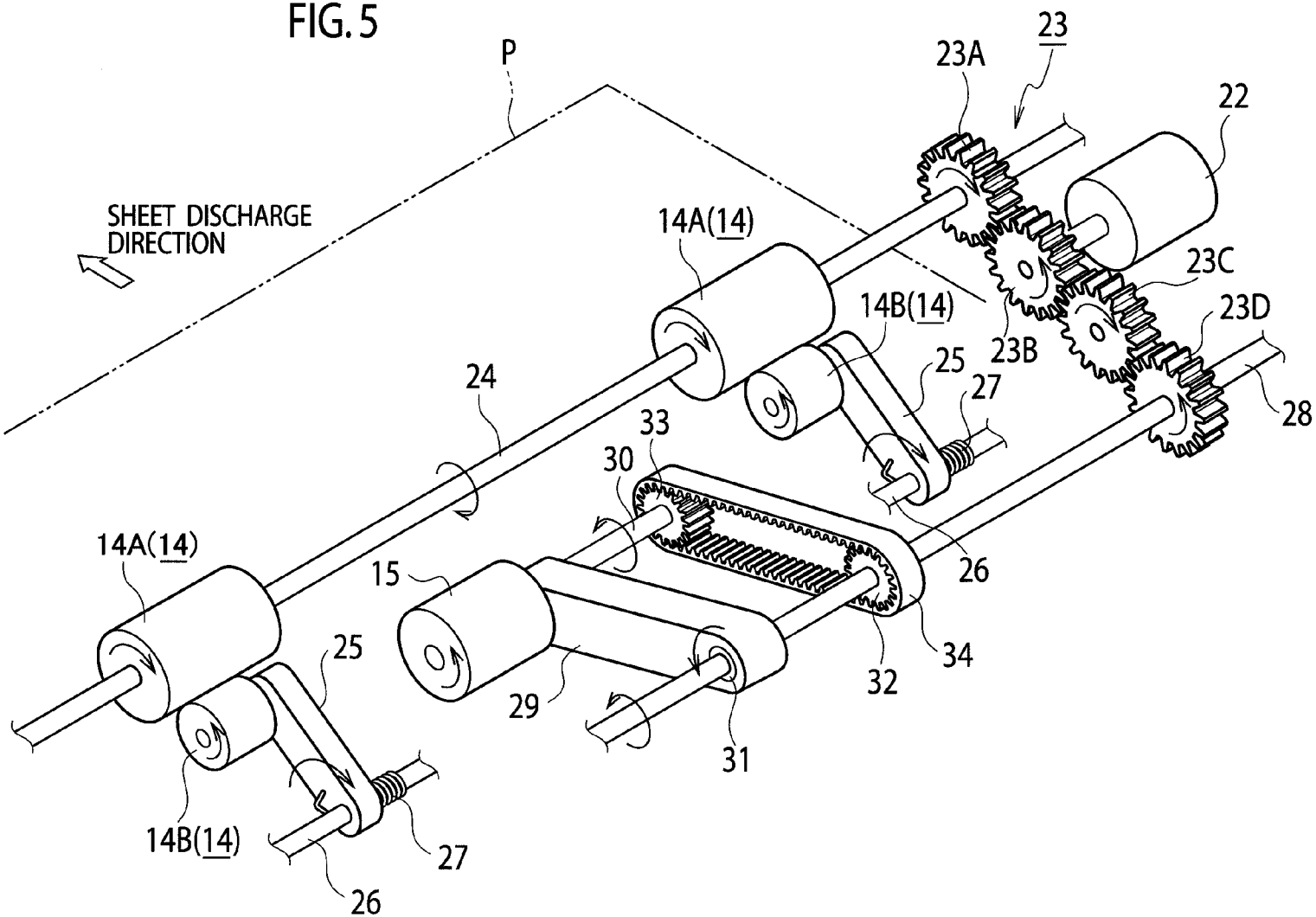
FIG. 5 is a perspective view showing a specific configuration example of each of sheet discharge rollers and a sheet reverse roller shown in FIG. 4.

As shown in FIG. 5, using a rubber material, the drive rollers 14A of the sheet discharge rollers 14 are fixed by baking to left and right sides of a first shaft 24 which extends in the width direction of the sheet P. The both ends of the first shaft 24 are supported rotatably through unillustrated bearings. A gear 23A of the gear train 23 is fixed to one end side of the first shaft 24 and caused to mesh with a gear 23B fixed to the shaft of the geared motor 22. Accordingly, each drive roller 14A is provided to be able to rotate clockwise together with the first shaft 24.

The driven rollers 14B of the sheet discharge rollers 14 are each supported rotatably on one end of a corresponding one of first arms 25 provided on the left and right sides correspondingly to the left and right drive rollers 14A. The other end of each first arm 25 is supported pivotally on a second shaft 26. The driven rollers 14B are made capable of rotational contact with the drive rollers 14A by the urging forces of torsion springs 27, respectively.

The gear 23B fixed to the shaft of the geared motor 22 is caused to mesh through an idler gear 23C with a gear 23D fixed to a third shaft 28. Accordingly, the third shaft 28, which is provided parallel to the first shaft 24 and whose both ends are supported rotatably through unillustrated bearings, is provided rotatably counterclockwise, i.e., in the opposite direction to the rotational direction of each drive roller 14A. A second arm 29 is attached pivotally to the third shaft 28.

All the gears 23A to 23D constituting the gear train 23 are formed to have the same diameter.

A fourth shaft 30 is supported rotatably on one end of the second arm 29 via an unillustrated bearing. The fourth shaft 30 has the sheet reverse roller 15 placed between the left and right drive rollers 14A and fixed to the fourth shaft 30 by using a sponge material. The other end of the second arm 29 is supported pivotally on the third shaft 28 via a bearing 31. Thus, via the second arm 29, the sheet reverse roller 15 can make rotational contact by its own weight with a sheet P therebelow.

A first timing pulley 32 is placed on a right side of the other end of the second arm 29 and fixed to the third shaft 28.

The fourth shaft 30 with the sheet reverse roller 15 fixed thereto extends to a right side of the one end of the second arm 29. A second timing pulley 33 formed to have the same diameter as the first timing pulley 32 is fixed to the end of the fourth shaft 30 extending from the one end of the second arm 29.

A timing belt 34 is laid between the first and second timing pulleys 32 and 33 so that the rotation of the third shaft 28 can be transmitted to the sheet reverse roller 15 via the fourth shaft 30.

With the above-described configuration, the sheet reverse roller 15 fixed to the fourth shaft 30 rotates at the same rotational speed as each drive roller 14A of the sheet discharge rollers 14 but in the opposite direction to the rotational direction of the drive roller 14A, i.e., counterclockwise, moving a discharged sheet P from the trailing end Pr thereof toward the alignment fence 13 and consequently, hitting the trailing end Pr against the alignment fence 13.

Now, sheet discharge operations in the sheet discharge device 10 of Example 1 having the above-described configuration will be described by using FIGS. 6A to 8.

Figure 6A:
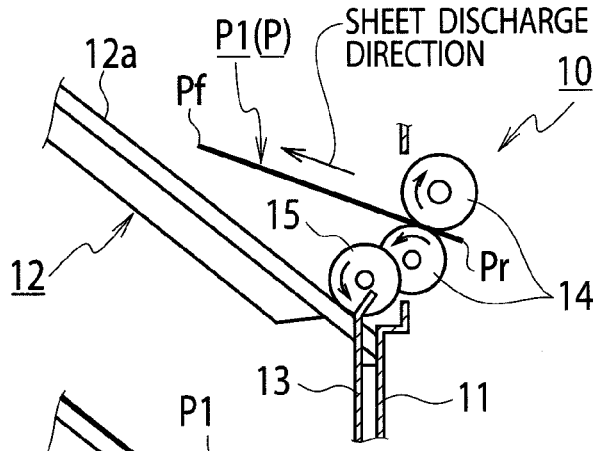
FIGS. 6A to 6E are operation diagrams for describing sheet discharge operations in the sheet discharge device according to Embodiment 1 of the present invention.

First, as shown in FIG. 6A, in a process to sequentially discharge sheets P at a high speed by rotating the sheet discharge rollers 14 in the sheet discharge device 10 of Embodiment 1, a discharge target sheet (first sheet) P1 is discharged from its leading end Pf at a high speed in the sheet discharge direction indicated by an arrow. During the discharge, the sheet reverse roller 15 is rotated counterclockwise.

Figure 6B:
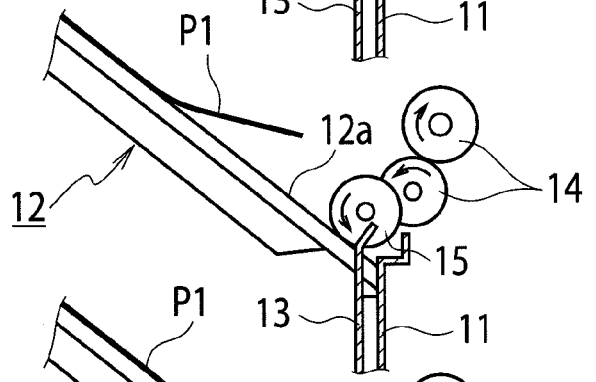

Then, as shown in FIG. 6B, the sheet P1 discharged by the sheet discharge rollers 14 falls on the top surface 12*a* of the sheet receiving tray 12.

Figure 6C:
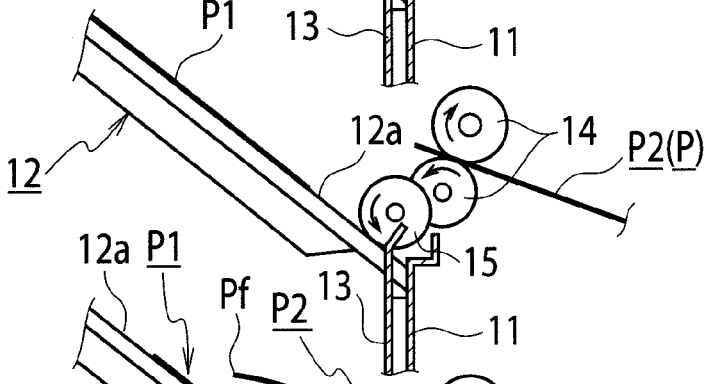

Then, as shown in FIG. 6C, the sheet P1 having fallen on the top surface 12*a* of the sheet receiving tray 12 lies along the top surface 12*a*. At the same time, the subsequent sheet (second sheet) P2 starts to be discharged by the sheet discharge rollers 14.

Figure 6D:
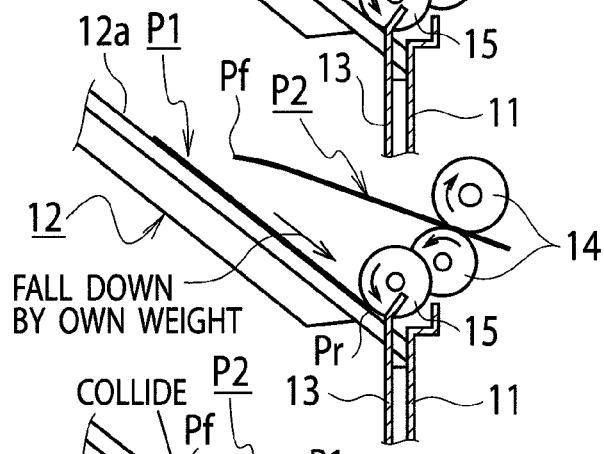

Then, as shown in FIG. 6D, the sheet P1 lying along the top surface 12*a* of the sheet receiving tray 12 falls down on the top surface 12*a* from its trailing end Pr by its own weight, i.e., by the inclination of the top surface 12*a*, and the trailing end Pr of the sheet P1 reaches and becomes nipped by the sheet reverse roller 15. As described, the leading end Pf of the subsequent sheet P does not collide with the previously discharged sheet P1 lying underneath, unlike the case of the prototype device 100A described earlier by using FIG. 3D. Hence, the lower sheet P1 nipped by the sheet reverse roller 15 is not moved in the widthwise direction and/or the lengthwise direction and therefore is not tilted on the sheet receiving tray 12.

Figure 6E:
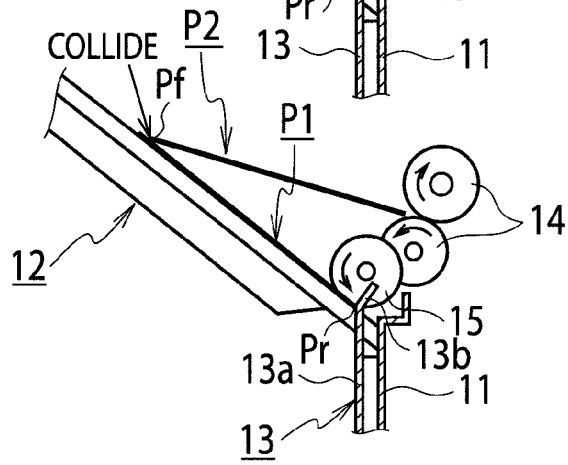

Then, as shown in FIG. 6E, the lower sheet P1 nipped by the sheet reverse roller 15 is caused to hit at its trailing end Pr against the sheet end portion 13*a* of the alignment fence 13 below the sheet guide portion 13*b* thereof along with the counterclockwise rotation of the sheet reverse roller 15. On the other hand, the subsequent sheet P2 is discharged by the sheet discharge rollers 14, and then the leading end Pf of the sheet P2 collides with the lower sheet P1. However, the lower sheet P1 is already nipped by the sheet reverse roller 15 and therefore is not moved by the subsequent sheet P2. Thereafter, the subsequent sheet P2 falls on the previously discharged, lower sheet P1, falls down by its own weight, and is then stacked on the previously discharged, lower sheet P1.

Thereafter, the above-described operations are repeated for multiple sheets P. The multiple sheets P stacked accordingly can be aligned along the alignment fence 13 on the sheet receiving tray 12 without being tilted.

As the amount of sheet P stacked on the sheet receiving tray 12 increases, the sheet receiving tray 12 is lowered in accordance with the stacked amount.

Now, of the above-described sheet discharge operations of Embodiment 1, the operations shown in FIGS. 6D and 6E will be described further in detail by using FIG. 7.

Figure 7:
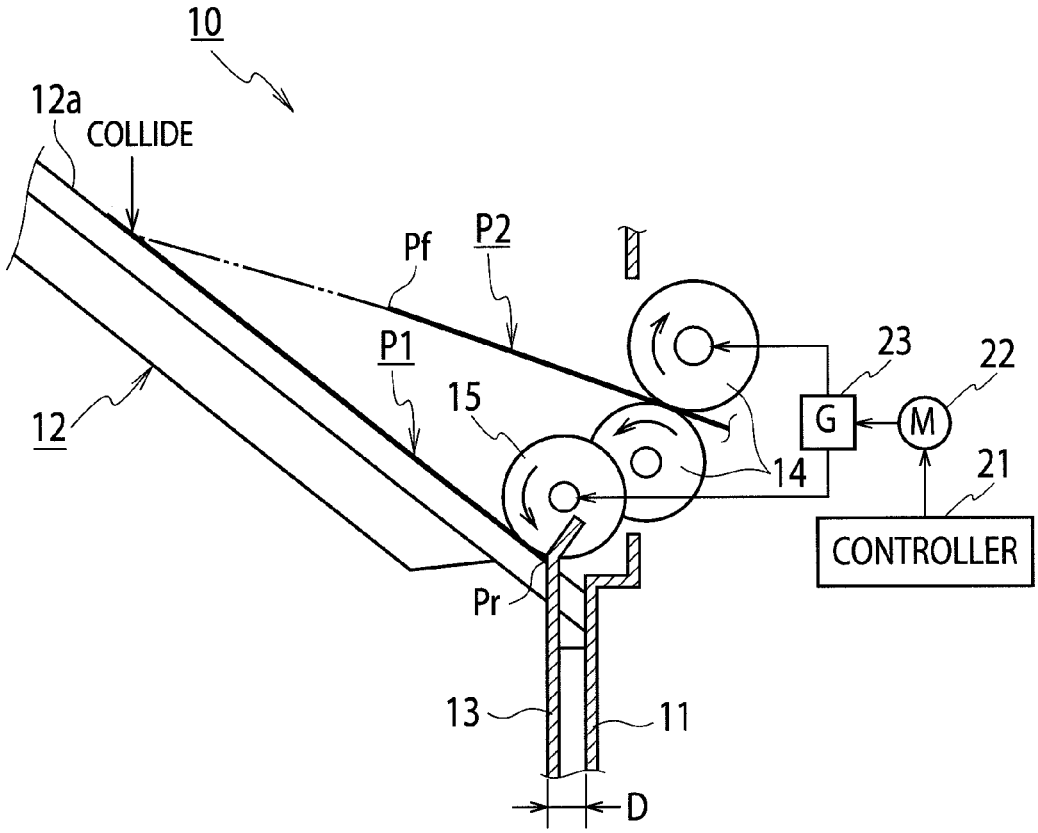
FIG. 7 is an enlarged diagram showing the sheet discharge operations shown in FIGS. 6D and 6E.

As shown in FIG. 7, the sheet discharge device 10 of Embodiment 1 assumes the following times and time interval.

$t_0$: time at which the trailing end Pr of the sheet P1 discharged previously by the sheet discharge rollers 14 leaves the sheet discharge rollers 14

$t_1$: time at which the sheet P1 falls on the sheet receiving tray 12

$t_2$: time at which the trailing end Pr side of the sheet P1 reaches and becomes nipped by the sheet reverse roller 15

$t_3$: time at which the leading end Pr side of the subsequent sheet P2 reaches and becomes nipped by the sheet discharge rollers 14 and starts to be discharged $t_4$: time at which the leading end Pf of the sheet P2 collides with the sheet P1

$T_k$: sheet time interval between the trailing end Pr of the sheet P1 and the leading end Pf of the sheet P2

Then, the times $t_0$ to $t_4$ listed above indicate times that occur in a time sequence with the time $t_0$ as a starting point.

The sheet time interval $T_k$ between the trailing end Pr of the sheet P1 discharged previously by the sheet discharge rollers 14 (first sheet) and the leading end Pf of the sheet P2 discharged subsequent to the sheet P1 (second sheet) is set at a value within a predetermined range that allows high speed sheet discharge. On this condition, the sheet reverse roller 15 is arranged at such a position relative to the sheet receiving tray 12 and the sheet discharge rollers 14 that the trailing end Pr of the sheet P1 can reach the sheet reverse roller 15 before the leading end Pf of the sheet P2 collides with the sheet P1 (i.e., time $T_1$ elapsed from $t_0$ to $t_2$<time $T_2$ elapsed from $t_0$ to $t_4$ can be satisfied). In other words, the sheet reverse roller 15 is arranged at such a position relative to the sheet receiving tray 12 and the sheet discharge rollers 14 that the trailing end Pr of the sheet P1 can reach the sheet reverse roller 15 before the leading end Pf of the sheet P2 collides with the sheet P1 in a case where the sheet discharge rollers 14 discharge sheets P at the minimum sheet time interval available in continuous sheet discharge in the sheet discharge device 10.

The sheet time interval $T_k$ is set at a value within the predetermined range that allows high speed sheet discharge, regardless of the sheet length, and is set to be shorter than half the value set in the case of the prototype device 100A described earlier by using FIGS. 3A to 3E (e.g., a value within a range of ±3% of V msec), which is a value within a range of ±3% of 0.45 V msec, for example.

The alignment fence 13 is arranged closer to the front side (sheet receiving tray 12 side) by the small distance D than is the outer side of the side panel 11. In addition, the sheet reverse roller 15 is arranged closer to the front side by the small distance D than is the sheet reverse roller 104 (FIGS. 3A to 3E) of the prototype device 100A. Moreover, the nipping point N of the sheet reverse roller 15 is so set that the sheet reverse roller 15 can make rotational contact in the region Yd (FIG. 8) of the margin Y on the trailing end Pr side of the sheet P.

With the above configuration, the trailing end Pr of a sheet P discharged on the sheet receiving tray 12 or an already stacked sheet(s) P is nipped by the sheet reverse roller 15, and after this nipping, the subsequently discharged sheet P is stacked on the previously discharged sheet P. As a result, as shown in FIG. 8, multiple sheets P stacked on the sheet receiving tray 12 can be aligned without being tilted when the trailing ends Pr of the multiple sheets P stacked on the sheet receiving tray 12 are caused to hit against the alignment fence 13 by the rotation of the sheet reverse roller 15. Accordingly, a sheet discharge device 10 with an improved quality can be provided.

In addition, since the position of the nipping point N of the sheet reverse roller 15 is set within the region Yd (FIG. 8) of the margin Y on the trailing end Pr side of the sheet P, the image G (FIG. 8) printed on the sheet P is not deteriorated. Accordingly, a fine image G can be provided.

Embodiment 2

Figure 9:
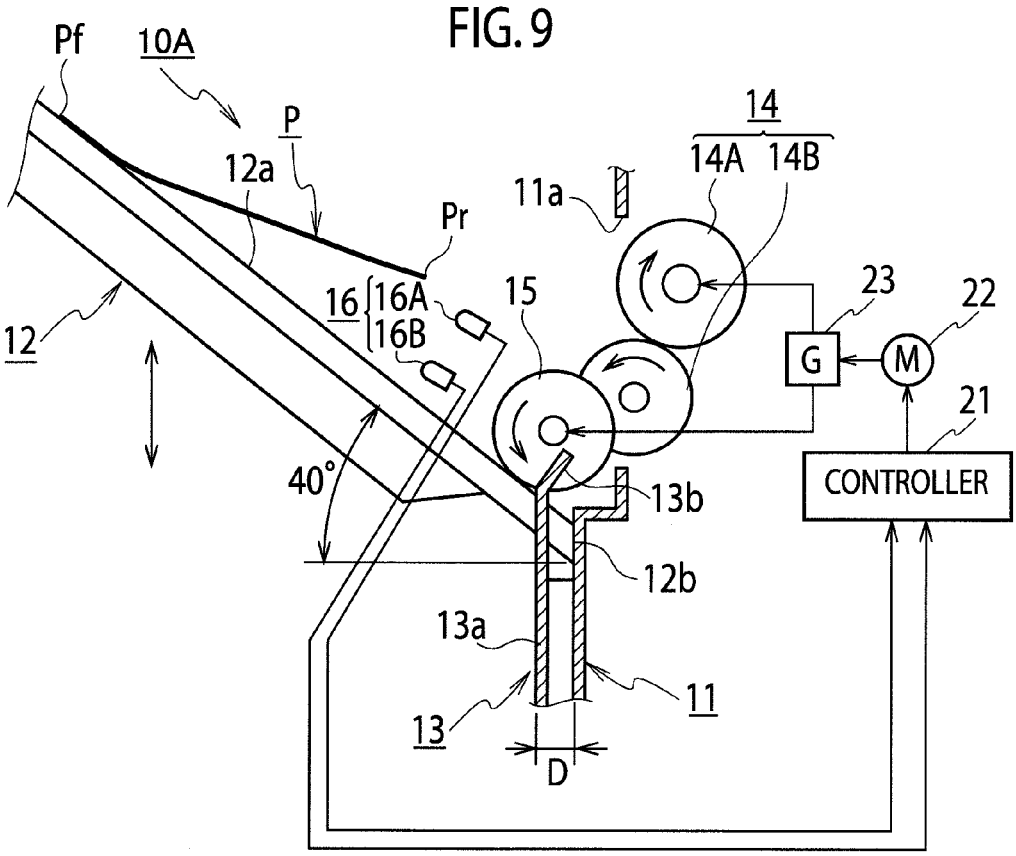
FIG. 9 is a configuration diagram showing a sheet discharge device according to Embodiment 2 of the present invention.

A sheet discharge device 10A according to Embodiment 2 of the present invention shown in FIG. 9 has the same configuration as the configuration of the sheet discharge device 10 of Embodiment 1 described above, except for one component. In this section, for the sake of convenience in description, the components described earlier are denoted by the same respective reference signs, and some of the components described earlier may be described as needed. Components different from Embodiment 1 are described with new reference signs.

As shown in FIG. 9, a sheet linear velocity detector 16 configured to detect the linear velocity of a sheet P having been discharged by the sheet discharge rollers 14 (hereinafter, also described as linear velocity after discharge) is arranged in the sheet discharge device 10A at a position allowing no contact with the sheet P that is being discharged. This feature is the only difference from the sheet discharge device 10 according to Embodiment 1.

In Embodiment 2, first and second optical sensors 16A and 16B are provided as an example of the sheet linear velocity detector 16, for example. The first and second optical sensors 16A and 16B are provided above and below a left side of the sheet reverse roller 15 with a gap between the first and second optical sensors 16A and 16B. By the first and second optical sensors 16A and 16B, the linear velocity of a sheet P after discharge can be detected while the sheet P is falling toward the sheet receiving tray 12.

Here, a linear velocity $V_1$ of the sheet P that is being discharged by the sheet discharge rollers 14 (hereinafter, also described as linear velocity $V_1$ during discharge) can be determined by the rotational speed of each drive roller 14A of the sheet discharge rollers 14. However, a linear velocity $V_2$ of the sheet P after discharge by the sheet discharge rollers 14 tends to be slower than the linear velocity $V_1$ during discharge because of: a frictional resistance caused when the leading end Pf of the sheet P collides with the top surface 12*a* of the sheet receiving tray 12 or an already stacked sheet(s) P thereon; a frictional resistance caused when the sheet P falls down by its own weight on the top surface 12 of the sheet receiving tray 12 or the already stacked sheet(s) P after the collision; the material and size of the sheet P; and the like.

In this respect, in Embodiment 2, the first and second optical sensors 16A and 16B each detect the trailing end Pr of the sheet P that has been discharged by the sheet discharge rollers 14 and is falling toward the top surface 12*a* of the sheet receiving tray 12 or the already stacked sheet(s) P, and notify the controller 21 of the detection results by means of signals or the like.

In this event, since the distance between the arranged positions of the first and second optical sensors 16A and 16B are stored in the controller 21 in advance, the controller 21 can measure the linear velocity $V_2$ of the sheet P after discharge by the sheet discharge rollers 14 by measuring the times at which the trailing end Pr of the falling sheet P passes the first and second optical sensors 16A and 16B. Thereafter, the controller 21 controls the rotation of the sheet reverse roller 15 to follow the linear velocity $V_2$ of the sheet P after discharge.

However, as described in Embodiment 1, the sheet reverse roller 15 uses the same drive source as each drive roller 14A of the sheet discharge rollers 14 and is therefore rotationally driven at the same rotational speed. For this reason, when the sheet reverse roller 15 follows the linear velocity $V_2$ of the sheet P after discharge, the drive roller 14A has to be controlled to be slower correspondingly. This is problematic when the subsequent sheet P needs to be discharged at a high speed.

To solve this, the controller 21 performs control in which the rotation of each drive roller 14A of the sheet discharge rollers 14 is set back at the linear velocity $V_1$ of the sheet P during discharge at a time at which the discharged sheet P reaches and becomes nipped by the sheet reverse roller 15 and at which the sheet discharge rollers 14 start to discharge the subsequent sheet P. In other words, the controller 21 controls the rotation of the sheet discharge rollers 14 and sheet reverse roller 15 such that the sheet discharge rollers 14 discharge the sheet P at the linear velocity $V_1$, while the sheet discharge rollers 14 are discharging the sheet P; on the other hand, the controller 21 controls the rotation of the sheet discharge rollers 14 and sheet reverse roller 15 such that the sheet reverse roller 15 moves the sheet P at the linear velocity $V_2$ detected by the sheet linear velocity detector 16, while the sheet discharge rollers 14 is discharging no sheet P.

Thus, the sheet reverse roller 15 is controlled based on the linear velocity $V_2$ of the sheet P during discharge by the sheet discharge rollers 14, and the sheet reverse roller 15 controlled at the linear velocity $V_2$ nips the discharged sheet P. Accordingly, when the sheet reverse roller 15 hits the trailing end Pr of the discharged sheet P against the alignment fence 13, the trailing end Pr of the sheet P can be aligned more securely than in the case of Embodiment 1.

Although illustration is omitted here, the rotation of each drive roller 14A of the sheet discharge rollers 14 and the rotation of the sheet reverse roller 15 may be controlled by separate drive sources, respectively. In this case, only the drive source of the sheet reverse roller 15 may be controlled when the sheet reverse roller 15 is to follow the linear velocity $V_2$ of the sheet P after discharge.

Like Embodiment 1, in Embodiment 2, in a process to sequentially discharge sheets P at a high speed by the sheet discharge rollers 14 onto the sheet receiving tray 12 inclined at the predetermined angle (approximately 40°), the sheet reverse roller 15 nips the trailing end Pr of a sheet P1 discharged onto the sheet receiving tray 12 by the sheet discharge rollers 14, and after this nipping, the subsequently discharged sheet P2 is stacked on the previously discharged sheet P1.

Hereinabove, embodiments of the present invention have been described. However, the present invention is not limited to the embodiments, and various modifications can be made thereto.

What is claimed is:

1. A sheet discharge device comprising:

a sheet discharge roller configured to sequentially discharge sheets in a sheet discharge direction with a leading end of each of the sheets in the lead;

a sheet receiving tray provided facing the sheet discharge roller and configured such that sheets discharged by the sheet discharge roller are sequentially stacked on the sheet receiving tray, the sheet receiving tray inclining relative to a vertical direction such that a side of a trailing end of each of the discharged sheets falls down by own weight thereof;

a sheet reverse member configured to move the side of the trailing end of a sheet in a direction opposite to the sheet discharge direction, the sheet being in a state of falling down by own weight thereof along any one of a top surface of the sheet receiving tray and a sheet already stacked on the top surface of the sheet receiving tray;

an alignment fence configured to contact with the trailing end of a sheet moved in the opposite direction by the sheet reverse member to align the trailing end of the sheet stacked on the sheet receiving tray;

a sheet linear velocity detector configured to detect a linear velocity of a sheet having been discharged by the sheet discharge roller, wherein the sheet reverse member is controlled based on a linear velocity detected by the sheet linear velocity detector, wherein the sheet reverse member is disposed at such a position relative to the sheet receiving tray and the sheet discharge roller that the trailing end of a first sheet discharged by the sheet discharge roller reaches the sheet reverse member before the leading end of a second sheet discharged subsequently to the first sheet collides with the first sheet when a sheet time interval between the trailing end of the first sheet and the leading end of the second sheet is set to a minimum sheet time interval available in continuous sheet discharge in the sheet discharge device.

2. The sheet discharge device according to claim 1, wherein the sheet reverse member is a rotatable sheet reverse roller configured to make rotational contact with a sheet, and the sheet reverse roller is disposed at a limit position in the sheet discharge direction beyond which the sheet reverse roller comes into contact with a sheet discharged by the sheet discharge roller and falling toward the sheet receiving tray.

3. The sheet discharge device according to claim 1, wherein the sheet reverse member is a rotatable sheet reverse roller configured to make rotational contact with a sheet, and the alignment fence is disposed at such a position relative to the sheet reverse roller that the sheet reverse roller contacts with a margin region on the side of the trailing end of a sheet set by the sheet discharge device.

4. The sheet discharge device according to claim 3, wherein the sheet discharge roller and the sheet reverse roller are configured to rotate at a same rotational speed, rotation of the sheet discharge roller and the sheet reverse roller is controlled such that the sheet discharge roller discharges a sheet at a first linear velocity while the sheet discharge roller is performing sheet discharge, and the rotation of the sheet discharge roller and the sheet reverse roller is controlled such that the sheet reverse roller moves a sheet at a second linear velocity detected by the sheet linear velocity detector while the sheet discharge roller is not performing sheet discharge.

5. A sheet discharge device comprising:

a sheet discharge roller configured to sequentially discharge sheets in a sheet discharge direction with a leading end of each of the sheets in the lead;

a sheet receiving tray provided facing the sheet discharge roller and configured such that sheets discharged by the sheet discharge roller are sequentially stacked on the sheet receiving tray, the sheet receiving tray inclining relative to a vertical direction such that a side of a trailing end of each of the discharged sheets falls down by own weight thereof;

a sheet reverse member comprising a rotatable sheet reverse roller configured to make rotational contact with a sheet and to move the side of the trailing end of a sheet in a direction opposite to the sheet discharge direction, the sheet being in a state of falling down by own weight thereof along any one of a top surface of the sheet receiving tray and a sheet already stacked on the top surface of the sheet receiving tray;

an alignment fence configured to contact with the trailing end of a sheet moved in the opposite direction by the sheet reverse member to align the trailing end of the sheet stacked on the sheet receiving tray; and a sheet linear velocity detector configured to detect a linear velocity of a sheet having been discharged by the sheet discharge roller, wherein rotation of the sheet reverse roller is controlled based on a linear velocity detected by the sheet linear velocity detector, wherein the sheet reverse member is disposed at such a position relative to the sheet receiving tray and the sheet discharge roller that the trailing end of a first sheet discharged by the sheet discharge roller reaches the sheet reverse member before the leading end of a second sheet discharged subsequently to the first sheet collides with the first sheet when a sheet time interval between the trailing end of the first sheet and the leading end of the second sheet is set to a minimum sheet time interval available in continuous sheet discharge in the sheet discharge device.

* * * * *